US009045948B2

(12) United States Patent
Roodenburg et al.

(10) Patent No.: US 9,045,948 B2
(45) Date of Patent: Jun. 2, 2015

(54) DRILLING INSTALLATION

(75) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 438 days.

(21) Appl. No.: 13/516,348

(22) PCT Filed: Dec. 13, 2010

(86) PCT No.: PCT/NL2010/050844

§ 371 (c)(1), (2), (4) Date: Aug. 21, 2012

(87) PCT Pub. No.: WO2011/074951

PCT Pub. Date: Jun. 23, 2011

(65) Prior Publication Data

US 2012/0305261 A1 Dec. 6, 2012

(30) Foreign Application Priority Data

Dec. 16, 2009 (NL) ..... 2003964

(51) Int. Cl.

| | |
|---|---|
| ***E21B 19/14*** | (2006.01) |
| ***E21B 7/00*** | (2006.01) |
| ***E21B 7/12*** | (2006.01) |
| ***E21B 15/02*** | (2006.01) |
| ***E21B 19/00*** | (2006.01) |
| *B63B 35/44* | (2006.01) |

(52) U.S. Cl.

CPC ..... *E21B 15/02* (2013.01); *E21B 19/14* (2013.01); *E21B 19/002* (2013.01); *E21B 19/143* (2013.01); *E21B 19/146* (2013.01); *B63B 35/4413* (2013.01)

(58) Field of Classification Search

USPC ..... 166/352, 258; 175/7; 114/201 R, 268, 114/269, 202

See application file for complete search history.

(56) References Cited

U.S. PATENT DOCUMENTS

| | | | | |
|---|---|---|---|---|
| 3,025,918 | A * | 3/1962 | Leven | 175/52 |
| 3,986,569 | A * | 10/1976 | Hilding et al. | 175/52 |
| 6,056,071 | A | 5/2000 | Scott et al. | |
| 6,217,258 | B1 | 4/2001 | Yamamoto et al. | |
| 2009/0196712 | A1 * | 8/2009 | Mortensen et al. | 414/22.68 |

FOREIGN PATENT DOCUMENTS

| | | | |
|---|---|---|---|
| GB | 2 071 734 | A | 9/1981 |
| WO | WO 02/18742 | A1 | 3/2002 |

* cited by examiner

*Primary Examiner* — James G Sayre

(74) *Attorney, Agent, or Firm* — Birch, Stewart, Kolasch & Birch, LLP

(57) ABSTRACT

A drilling installation for drilling a well, for example an oil, a gas, or a thermal well, includes a tower structure, a first hoisting device adapted to manipulate a first object in a first firing line in the longitudinal direction of the tower structure, a second hoisting device adapted to manipulate a second object in a second firing line in the longitudinal direction of the tower structure, a storage device for vertically storing tubular elements, such as joined tubulars, and a first pipe racker for moving tubular elements between the storage device and the first firing line. The first and second firing line are located outside the tower structure.

20 Claims, 6 Drawing Sheets

DRILLING INSTALLATION

The invention relates to a drilling installation for drilling a well, for example an oil, a gas, or a thermal well, by means of said drilling installation. The invention also relates to a vessel comprising such a drilling installation and a method for drilling a well which makes use of such a drilling installation.

In the oil and gas well drilling industry numerous types of piping, generally referred to as "tubulars" or "tubular elements", are used. Tubular elements include drill pipes, casing pipes, and other connectable (e.g. by screwthread) oil and gas well structures. Long "strings" of joined tubulars, e.g. drill strings or casing stands, are typically used to drill a wellbore and to prevent collapse of the wellbore after drilling.

The applicant has disclosed in international publication WO 02/18742 A1 a drilling installation comprising a drilling mast. Said installation comprises first hoisting means adapted to manipulate a first object, such as a drill string, in a first firing line in the longitudinal direction of the drilling mast, and second hoisting means adapted to manipulate a second object, such as a second drill string, in a second firing line in the longitudinal direction of the drilling mast. The first and second firing line are located outside the drilling mast, i.e. the tower structure.

Connected to each lateral side of the known drilling mast is a carrousel type storage device for vertically storing tubular elements, such as joined tubulars, i.e. multi length pipe sections. The storage devices are rotatable about a vertical axis and have storage slots for storage of multiple tubulars in each storage device in a vertical orientation. Each storage device has a drive to rotate the storage device about its vertical axis. In general storage devices for tubulars in the oil and gas industry are referred to as "fingerboard", "setbacks", "setback drums", and "pipe racks", etc.

In the known drilling installation each lateral side of the drilling mast is provided with two pipe rackers, one pipe racker for moving tubular elements between the storage device and the first firing line, and the other pipe racker for moving tubular elements between the storage device and the second firing line. The pipe rackers include a vertical column member supporting multiple gripping members that allow to grip or engage on a tubular at different positions along its length. The one or more gripping members are each fitted on an articulated arm having an associated drive to move the arm, so that the griping member is moveable within a reach of the assembly.

A disadvantage of this configuration is that if a pipe racker fails, no tubular elements can be moved anymore between the storage device and the respective firing line. In some drilling operations, transfer of tubular elements between a firing line and the storage device is performed at a high frequency. Therefore, any failure of the installation may cause undesirable delay of the operation. Theoretically, if a pipe racker fails, the other three pipe rackers are able to transport a tubular element from the storage device to the firing line via the other storage device and firing line. However, this is a complex and time inefficient process.

It is therefore an object of the invention to provide an improved drilling tower.

This object is achieved by providing a drilling tower according to the preamble of claim 1, characterized in that the storage device is located inside the tower structure, in that the first pipe racker is also configured for moving tubular elements between the storage device and the second firing line, in that the installation preferably comprises a second pipe racker for moving tubular elements between the storage device and the second firing line, and preferably the second pipe racker is also configured for moving tubular elements between the storage device and the first firing line, and in that the first pipe racker, and the second pipe racker if applicable, are configured to move tubular elements between the storage device and the first or second firing line via an opening in the tower structure, wherein said opening has a length which is at least equal to a maximum length of a tubular element in the storage device.

The phrase "inside the tower structure" is meant to be interpreted that an object, in this case the storage device, is substantially inside a vertical projection of the tower structure in top view. In other words, inside the tower structure means that an object is substantially surrounded by portions of the tower structure, except possibly at the location of the opening in the tower structure. It also means that portions of the object may extend outside the tower structure as long as the main portion is inside the tower structure.

An advantage of the preferred embodiment is that with the storage device inside the tower structure the first pipe racker and second pipe racker are able to pass the storage device and can also reach the other firing line for moving tubular elements from the storage to said firing line, so that in case a pipe racker fails, the other pipe racker is able to take care of both firing lines without using complex processes.

Another advantage is that complex motions of the tubular elements, such as moving from a vertical state in the storage device to an inclined state and back to a vertical state in the firing line when the tubular elements have to pass the opening are prevented due to the sufficient length of the opening in the tower structure.

In an embodiment, the first pipe racker, and the second pipe racker if applicable, are moveable between the first firing line side of the tower and the second firing line side of the tower. This extends the reach of the pipe racker significantly which is advantageous for reaching both firing lines. The allowable reach may also be increased by providing mechanisms in the form of parallelogram linkages or robotic arm structures. The advantage of a moveable pipe racker is that it is an easier way of extending the reach of the pipe rackers instead of linkages or arm structures which are most of the time bulky elements with complex design. Further, it allows both pipe rackers to be used in combination with each firing line in case of two pipe rackers.

In case each of the first pipe racker, and second pipe racker if applicable, comprises a column member supporting one or more gripping members, the moveability of the first and second pipe racker may be implemented by providing guides for both ends of the column member along which the column member is able to move.

Alternatively, the column members may be provided on a rotary structure that is rotatable about a vertical axis, wherein a drive is provided to rotate the rotary structure about said vertical axis. The rotary structure supports at a first side thereof the first pipe racker and at a second side thereof the second pipe racker. In a first rotary position of the rotary structure, the first pipe racker is operable to move a tubular element between the storage device and the first firing line, and the second pipe racker is operable to move a tubular element between the storage device and the second firing line. In a second rotary position of the rotary structure, the first pipe racker is operable to move a tubular element between the storage device and the second firing line, and the second pipe racker is operable to move a tubular element between the storage device and the first firing line. In case of failure of one of the first or second pipe racker, this installation allows to rotate the rotary structure so that the still functioning pipe racker can be used in combination with each firing line. This allows to reduce the impact of the malfunction on drilling operations.

In another embodiment, the tower structure comprises a first leg and a second leg at a distance of the first leg, the first leg accommodating the storage device and being provided with said opening, wherein the first pipe racker, and the second pipe racker if applicable, are located between the first and second leg of the tower. The second leg allows for an increased design freedom to place the firing lines without inducing high bending or torsion stresses in the tower structure.

Preferably, said opening in the first leg faces the second leg, so that the pipe rackers can easily access the storage device from in between the two legs.

In another embodiment, a further storage device is located in the second leg, the second leg being provided with a respective opening through which tubular elements can be moved between the further storage device and the first or second firing line by the first pipe racker, and second pipe racker if applicable, and wherein the length of opening in the second leg is at least equal to a maximum length of a tubular element in the further storage device.

Preferably, the second leg is similar to the first leg. Also a symmetric design is possible in which the second leg is the mirror of the first leg.

More preferably, the opening in the first leg and the opening in the second leg face each other.

In an embodiment, the tower structure is a lattice structure, preferably the tower structure comprises an U-shaped cross section in plan view. In case the tower structure comprises a first leg and a second leg, wherein each leg accommodates a storage device, both the first and second leg have a U-shaped cross section in plan view.

In another embodiment, the storage device is a rotary storage device having a substantial vertical axis of rotation, so that the orientation of the pipe rackers can be substantially the same when taking tubular elements from the storage device by rotation of the storage device and presenting tubular elements substantially in the same position to the pipe rackers. Rotation of the storage device can be provided by a respective drive.

In an embodiment, the tower comprises a base with a construction floor, preferably a moveable construction floor, more preferably a vertically moveable construction floor for each firing line, wherein the tower structure with the storage device and the first pipe racker, and second pipe racker if applicable, are located on the base, i.e. on top of the base. Preferably, the construction floor comprises openings for the respective firing line.

Preferably, the first pipe racker, and second pipe racker if applicable, each comprise one or more gripping members adapted to grip a tubular. More preferably, the first and second pipe racker each comprise a vertical column member supporting the respective one or more gripping members.

The invention further relates to a vessel, e.g. a semi-submersible comprising a drilling installation according to the invention.

The vessel may comprise a moon pool, wherein the drilling installation is placed over the moon pool. Additionally or alternatively, the vessel may comprise a deck with openings for each firing line.

It is to be noted explicitly here that the drilling installation according to the invention can be used for drilling on land as well as for drilling at sea.

The invention also relates to a method for drilling a well, wherein use is made of a drilling installation according to the invention.

The invention will now be described in a non-limiting way with reference to the drawing, in which like tubular elements have like reference numerals. In the drawing.

Figure 1:
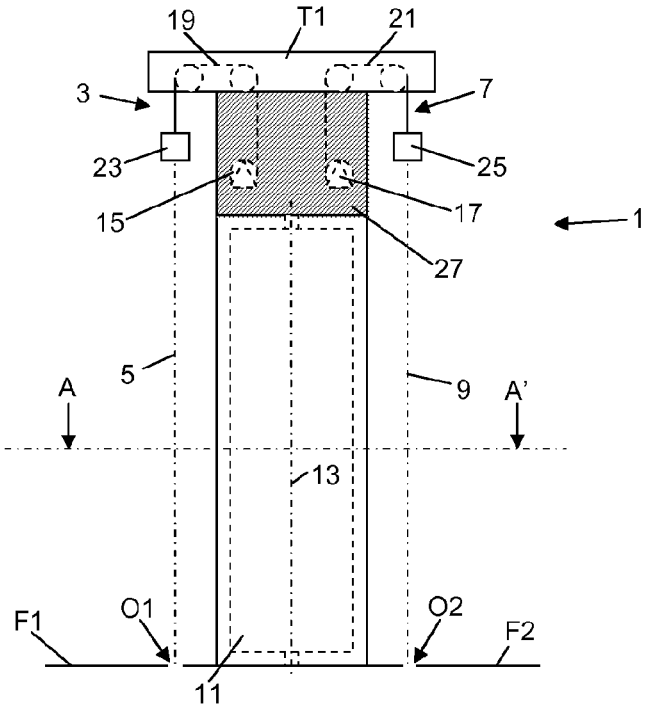
FIG. 1 shows schematically an embodiment of a drilling installation according to the invention in side view.

FIG. 1 shows schematically a drilling installation 1 according to an embodiment of the invention in side view. The drilling installation comprises a tower structure T1, and first hoisting means 3 located at a top of the tower structure T1 and provided in a first firing line 5 for manipulating a first object, such as a drill string, in the longitudinal direction of the tower structure T1.

On an opposite side of the tower structure T1, second hoisting means 7 are provided at the top of the tower structure T1 in a second firing line 9 for manipulating a second object, such as a drill string, in the longitudinal direction of the tower structure T1.

The installation 1 further comprises a storage device 11 for vertically storing tubular elements, such as joined tubulars. The storage device 11 is located inside the tower structure T1 and is therefore shown with dashed lines. In this embodiment, the storage device is a rotary storage device capable of rotating about a vertical axis 13.

The first and second hoisting means 3,7 comprise a respective hoisting winch 15,17, hoisting cable 19,21, and tubular engagement means 23,25. The tubular engagement means are configured to engage with tubulars, for hoisting and/or rotating said tubulars. The tubular engagement means 23,25 are connected to the respective hoisting cable 19,21 which can be hauled in or paid out by the respective hoisting winch 15,17. The hoisting winches are now located in a top structure 27 of the tower structure T1, but can be located anywhere, including on the outside of the tower structure T1 (see for example FIG. 9).

The tubular engagement means 23, 25 may be part of a respective trolley which is connected to the respective hoisting cable 19,21. Said trolley is then preferably guided along the tower structure, preferably along the outside of the tower structure, in the longitudinal direction of the tower structure. By using a trolley it is ensured that the tubular engagement means 23,25 are located in the respective firing line, which is especially advantageous for performing drilling operations at sea where the sea induced motions may cause the hoisting cables and tubular engagement means to swing out of the respective firing line.

The first and second firing line 5,9 are both located outside of the tower. This has the advantage that tubulars can also be fed in from the outside of the tower structure. A further advantage may be that bulky equipment, for instance a BOP, can easily be introduced in a firing line from the outside of the tower structure.

The installation further comprises a construction floor F1, F2 for each firing line. The construction floor may be configured as a deck when the installation is used at sea on a vessel (not shown). Each construction floor has a respective opening O1,O2 for each firing line to allow the passage of tubulars.

Different possible configurations of the installation 1 will be explained with respect to FIGS. 2-5, which show a cross sectional view of the installation in plan view as indicated by arrows A-A'. It is noted here explicitly that the configurations of FIG. 2-5 do not necessarily have to be dependent on the embodiment of FIG. 1. They may also serve as an example of independent embodiments having a side view that is different from the side view in FIG. 1.

Figure 2:
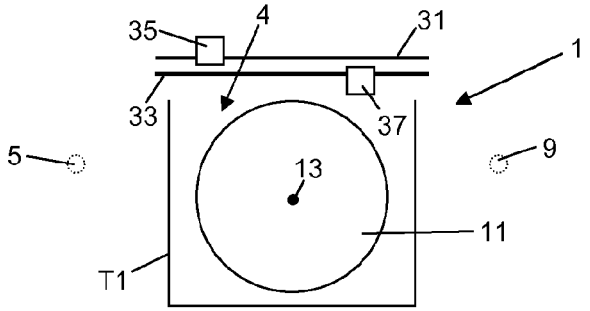
FIG. 2 shows schematically a cross section of another embodiment of a drilling installation according to the invention in plan view.

FIG. 2 depicts schematically a cross sectional view of another embodiment of a drilling installation 1 according to the invention in plan view, which may be a cross sectional view of the drilling installation 1 of FIG. 1. The installation 1 comprises a tower structure T1 with an opening 4, wherein a storage device 11 is located inside the tower structure. The storage device is of the rotary type, i.e. a carrousel and is rotatable about vertical rotation axis 13.

On opposite sides of the tower structure are provided a first firing line 5 and a second firing line 9, which are located outside of the tower structure.

The tower structure T1 has an U-shaped cross section and may be a lattice structure to reduce the weight of the tower with respect to a structure having closed wall portions. However, closed wall portions may be preferred for instance from safety point of view or to reduce the influence from wind.

At the opening 4 of the U-shaped cross section of the structure, two tracks, i.e. guides, 31,33 are provided for example in the form of rails, to allow respectively a first pipe racker 35 and a second pipe racker 37 to move between the first firing line side of the tower and the second firing line side of the tower.

The first and second pipe racker are shown schematically here, but can reach into the storage device to grip a tubular element from or to place a tubular element in the storage device, and are able to reach the first or second firing line when they are near the ends of the respective tracks.

As both the first and second pipe rackers can travel between the first firing line side of the tower and the second firing line side of the tower, they can both move tubular elements between the storage device and the first firing line and between the storage device and the second firing line, which is advantageous when one of the pipe rackers fails.

The opening 4 has a length which is at least equal to a maximum length of a tubular element in the storage device, so that the first and second pipe racker can move a tubular element between the storage device and one of the firing lines via the opening without having to alter the vertical orientation of the tubular element.

In an alternative embodiment, the pipe rackers may be stationary, but then means need to be provided so that the pipe rackers are still able to get to both the first and second firing line. These means may comprise for instance parallelogram linkages and/or robotic arms.

Figure 3:
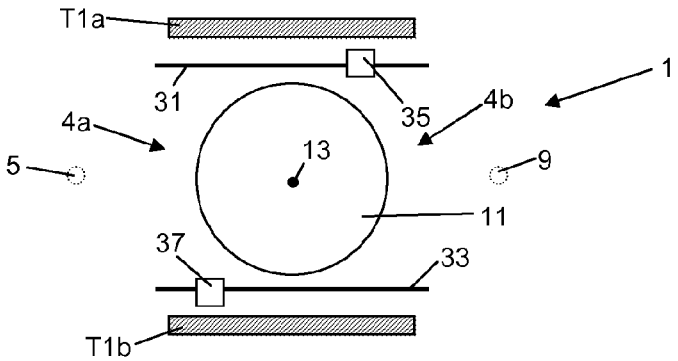
FIG. 3 shows schematically a cross section of yet another embodiment of a drilling installation according to the invention in plan view.

FIG. 3 shows schematically a cross sectional view of yet another embodiment of a drilling installation 1 according to the invention in plan view, which may be a cross sectional view of the drilling installation 1 of FIG. 1.

The installation 1 comprises a tower structure having a side portion T1*a* and a side portion T1*b*. At the top of the tower are located first and second hoisting means, which are provided in respectively a first firing line 5 and a second firing line 9 to manipulate objects in a longitudinal direction of the tower structure.

In between the two side portions T1*a*,T1*b*, a storage device 11, in this case a rotary storage device, is provided which is able to rotate about a vertical axis 13. The structure has two openings 4*a*, 4*b* for each firing line to allow tubular elements to move between the storage device and the respective firing line via the respective opening.

At each side portion, a respective track 31,33 is shown extending from the first firing line side of the tower structure to the second firing line side of the tower structure. Along the tracks 31, 33 associated first and second pipe rackers 35,37 are able to move. Each pipe racker is configured for moving tubular elements between the storage device and the first or second firing line. As the tracks extend from the first firing line side to the second firing line side, both pipe rackers are able to serve both firing lines. In case one pipe racker fails, the other pipe racker can take over the job of the failing pipe racker.

Both the openings 4*a*,4*b* have a length which is at least equal to a maximum length of a tubular element in the storage device.

The side portions T1*a*,T1*b* of the structure are preferably connected to each other to form a rigid structure. At least the side portions are connected at their top to accommodate at least a part of the hoisting means. In fact, the side portions T1*a*,T1*b* of the structure may be regarded as legs of the tower structure, wherein the storage device is located in between the legs of the tower structure.

Figure 4:
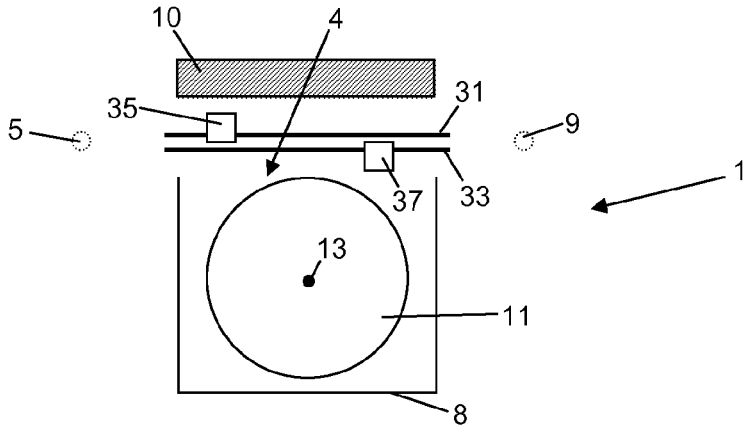
FIG. 4 shows schematically a cross section of a further embodiment of a drilling installation according to the invention in plan view.

FIG. 4 shows schematically a cross sectional view of a further embodiment of a drilling installation 1 according to the invention in plan view, which may be a cross sectional view of the drilling installation 1 of FIG. 1.

The installation 1 comprises a tower structure with a first leg 8 having an U-shaped cross section in plan view and an opening 4. A storage device 11 is located inside the first leg for vertically storing tubular elements which can be moved from or to the storage device via opening 4. In this case, the storage device is a rotary storage device that can rotate about a vertical axis 13.

At a distance from the first leg 8, a second leg 10 is provided. The opening 4 in the first leg 8 faces the second leg 10 and has a length which is at least equal to a maximum length of a tubular element in the storage device.

At the top of the tower structure first and second hoisting means are located and provided in respectively a first and second firing line 5,9 for manipulating objects.

To move the tubular elements between the storage device and the first or second firing line, a first piperacker 35 and a second pipe racker 37 are provided between the two legs 8,10 of the tower structure. Both pipe rackers are moveable along respective tracks 31,33 which extend from the first firing line side of the tower structure to the second firing line side of the tower structure.

Figure 5:
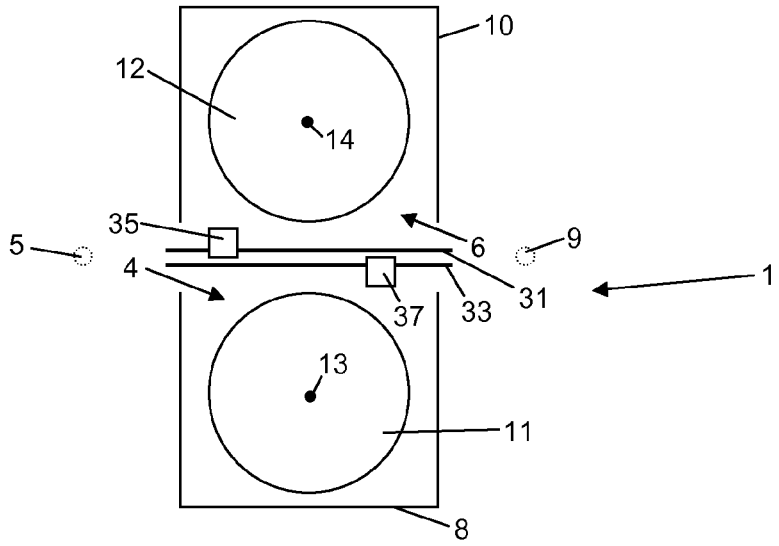
FIG. 5 shows schematically a cross section of yet a further embodiment of a drilling installation according to the invention in plan view.

FIG. 5 shows a cross sectional view of yet a further embodiment of a drilling installation 1 according to the invention, which may be a cross sectional view of the drilling installation 1 according to FIG. 1.

The installation 1 comprises a tower structure with a first leg 8 having an opening 4. Opposite the first leg 8 is provided a second leg 10 with an opening 6 that faces the opening 4 of the first leg 8. Both the first leg and the second leg have a U-shaped cross section. Inside each leg 8,10 a respective storage device 11,12 is located for storing vertical tubular elements. Each storage device 11,12 is a rotary storage device rotatable about respective vertical axes 13 and 14.

At the top of the tower 1 first and second hoisting means are located and provided in a respective first firing line 5 and a second firing line 9 for manipulating objects.

In between the two legs, a first pipe racker 35 and a second pipe racker 37 are provided to move tubular elements between one of the storage devices and one of the firing lines. In principle first pipe racker 35 is associated with the storage device 12 inside second leg 10 and the first firing line 5, and the second pipe racker 37 is associated with storage device 11 inside the first leg 8 and the second firing line 9. However, the pipe rackers are also able to reach the other storage device for moving tubular elements between said storage device and the associated firing line.

Further, the pipe rackers 35,37 are moveable along respective tracks 31,33 and are therefore also configured to move tubular elements between one of the storage devices and the other firing line, so that in case one of the pipe rackers fails, the other pipe racker can take over.

Both the openings 4 and 6 have a length which is at least equal to a maximum length of tubular element in the respective storage devices.

Figure 6:
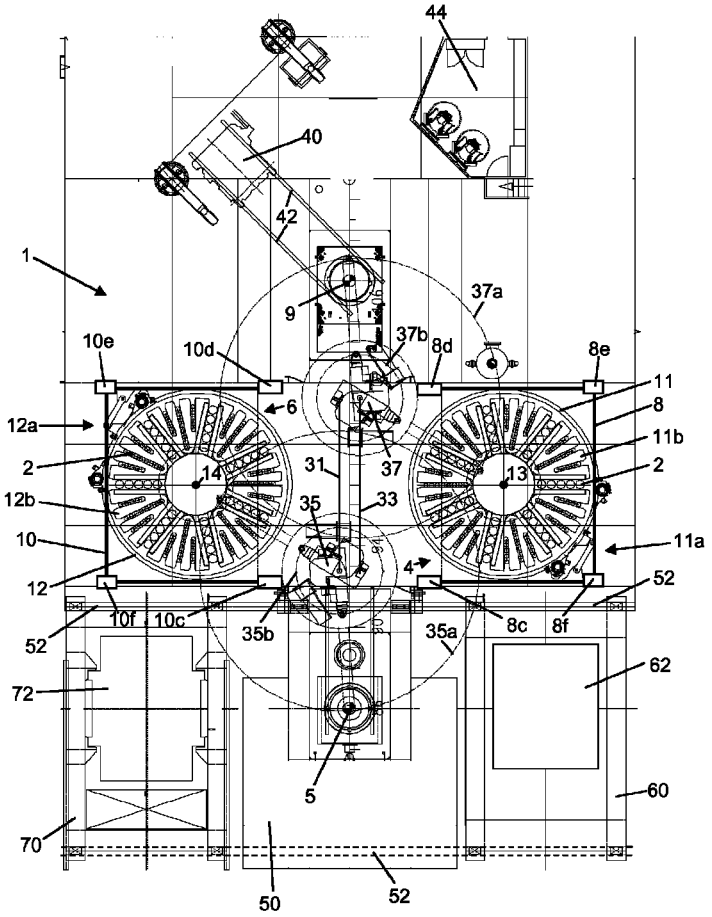
FIG. 6 shows in more detail a cross section of an embodiment of a drilling installation according to the invention similar to the embodiment of FIG. 5 in plan view.

FIG. 6 shows in detail an embodiment of a drilling installation 1 according to the invention, which embodiment has a similar configuration as the embodiment of FIG. 5.

The installation 1 comprises a tower structure, first hoisting means located at the top of the tower structure and provided in a first firing line 5 for manipulating a first object in the longitudinal direction of the tower structure, and second hoisting means located at the top of the tower structure and provided in a second firing line 9 for manipulating a second object in the longitudinal direction of the tower structure.

The tower structure comprises a first leg 8 with an opening 1 and a second leg 10 with an opening 6.

The installation 1 further comprises a storage device 11 and a storage device 12 located inside respectively the first leg 8 and the second leg 10 for vertically storing tubular elements, such as tubulars 2 of which only a few are indicated by reference numeral 2.

The openings 4 and 6 have a length which is at least equal to a maximum length of the tubulars 2 in the respective storage devices such that the tubulars can be moved between the storage devices and the firing lines via the opening in a vertical orientation.

A first pipe racker 35 (shown in two positions in FIG. 6) is provided for moving tubular elements between the storage device 12 and the first firing line 5, and a second pipe racker 37 (shown in two positions in FIG. 6) is provided for moving tubular elements between the storage device 11 and the second firing line 9.

The first and second firing line 5,9 are located outside of the tower structure, e.g. to feed in tubular elements, i.e. tubulars 2, from the outside of the tower structure.

The first pipe racker 35 is also configured to move tubular elements between the storage device 12 and the second firing line 9, and the second pipe racker 37 is also configured to move tubular elements between the storage device 11 and the first firing line 5. As there are two storage devices, the first pipe racker is in this embodiment also configured to move tubular elements between the storage device 11 and both the first and second firing line, and the second pipe racker is also configured to move tubular elements between the storage device 12 and both the first and second firing line.

The pipe rackers are able to rotate about a vertical axis and comprise gripping members which are able to translate in a direction perpendicular to said vertical axis. The resulting reach of the pipe rackers is shown by two circles per pipe racker, respectively the circles 35*a* and 35*b* for the first pipe racker 35 and the circles 37*a* and 37*b* for the second pipe racker 37. The area between the two respective circles of a pipe racker define the reach of said pipe racker in the shown position. The pipe rackers are also capable of moving along respective tracks 31,33 which extend from the first firing line side to the second firing line side of the tower structure. The pipe rackers are therefore able to reach both the storage devices and both the firing lines.

The storage devices 11, 12 are rotary storage devices and are rotatable about respective vertical axes 13,14 by drives 11*a*,12*a* which are arranged between the structure 8,10 and the storage device. Part of the drives 11*a*, 12*a*, may extend outside the tower. The storage devices further comprise fingerboards 11*b*, 12*b* to hold the tubulars 2 in a vertical position.

Both pipe rackers are configured to move tubular elements between one of the storage devices and one of the firing lines via the respective opening in the structure accommodating the storage device.

Shown around the first firing line 5 is a construction floor 50 which allows access to the first firing line. The construction floor is moveable in the vertical direction in order to make room for a BOP 72 or a so-called Christmas tree 62. The Christmas tree 62 is provided on a moveable frame 60 which can slide or ride in horizontal direction along guides 52 in and out of the first firing line. The BOP 72 is provided on a moveable frame 70 which can slide or ride in horizontal direction along guides 52 in and out of the first firing line.

Each first and second leg is provided with respective stands 8*c*-8*f*, 10*c*-10*f* in between a lattice structure is arranged to form a rigid structure.

The construction floor 50 is vertically guided along stands 10*c* and 8*c*. These stands 8*c*,10*c* may also be used to guide a trolley which may form part of the first hoisting means. At the second firing line side of the tower structure, a similar trolley may be provided as part of the second hoisting means which is then preferably guided along stands 8*d*,10*d* of respectively the first and second leg.

The second firing line is surrounded by a stationary construction floor on which a rough neck 40 is provided which can move into and out of the second firing line by moving horizontally along guides 42 for connecting tubular elements together in the second firing line. The drilling process in the second firing line can be watched or controlled from a control room 44.

Figure 7:
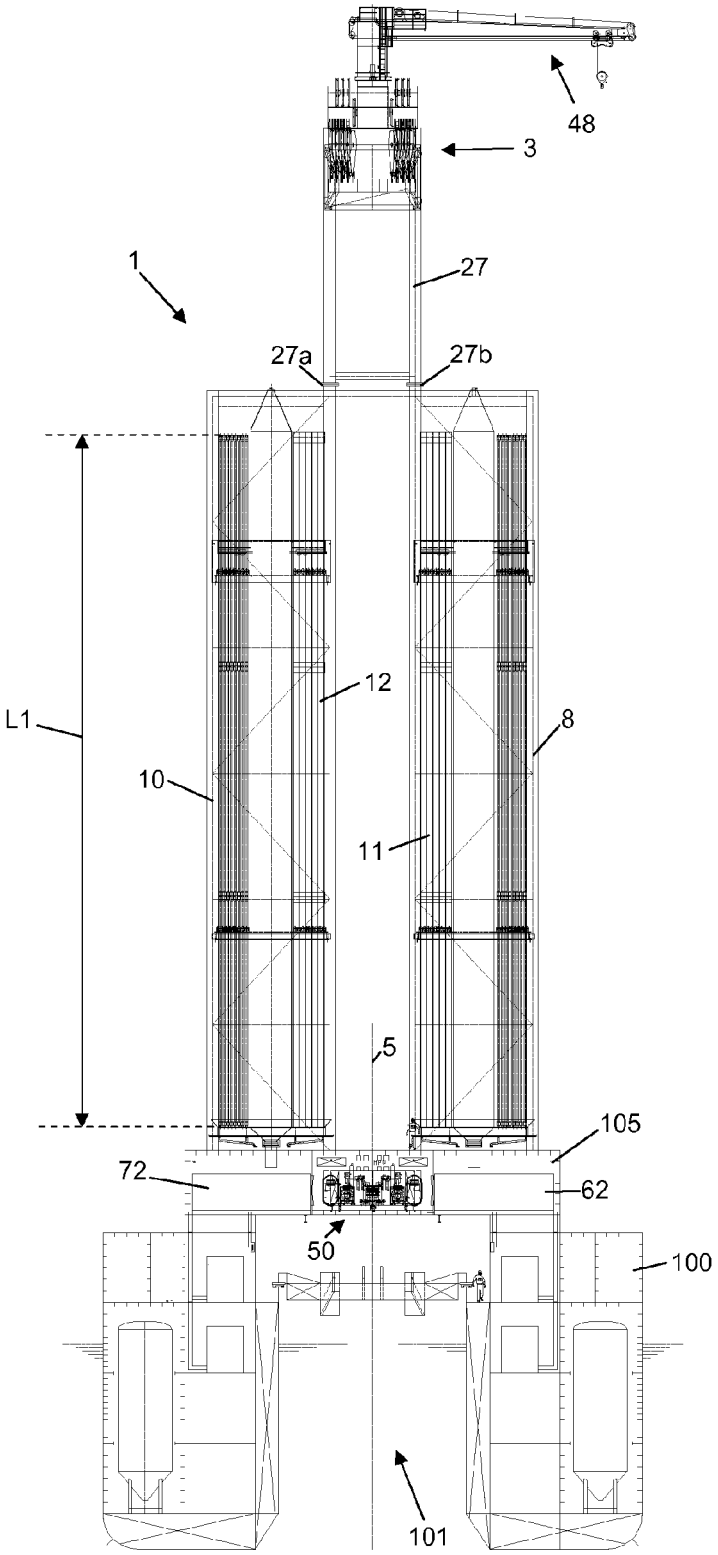
FIG. 7 shows the embodiment of the drilling installation according to FIG. 6 in side view.

FIG. 7 shows a side view of a vessel 100, e.g. a semi-submersible, equipped with a drilling installation 1 according to FIG. 6. As shown in FIG. 7, the installation 1 has first hoisting means 3 located at the top of the tower structure and provided in the first firing line 5. On the opposite side of the tower structure which faces away in this view, second hoisting means are located and provided in the second firing line similar to the embodiment of FIG. 1.

On top of the tower structure a crane 48 is located to aid in the drilling operation. The crane 48 is capable of revolving 360 degrees about a vertical axis. The first and second hoisting means and crane 48 are accommodated in top structure 27 which is connected to a first leg 8 and second leg 10 via flanges 27*a* and 27*b*. This makes the assembly and disassembly of the tower structure relatively simple. Both the first and second leg 8, 10 accommodate a respective storage device 11, 12.

It can be clearly shown in FIG. 7 that the first and second leg 8, 10 are in this embodiment lattice structures. For simplicity reasons, the pipe rackers from FIG. 6 are not depicted in FIG. 7. However, the pipe rackers, the first and second leg 8, 10 and the storage devices 11,12 are placed on top of a base 105 of the vessel 100.

The base 105 comprises the construction floors, in this case formed as decks, for the first and second firing line, in this case only construction floor 50 can be seen. Adjacent the construction floor are provided the BOP 72 and the Christmas tree 62.

The vessel or semi-submersible 100 has a moon pool 101 in its hull, wherein the drilling installation is placed over the moon pool 101 to perform operations through the moon pool 101.

From FIG. 7 it can be seen that the maximum length of tubulars in the storage devices is L1. The openings 4 and 6 in respectively first leg 8 and second leg 10 as shown in FIG. 6 have a length which is at least equal to the maximum length L1.

Figure 8:
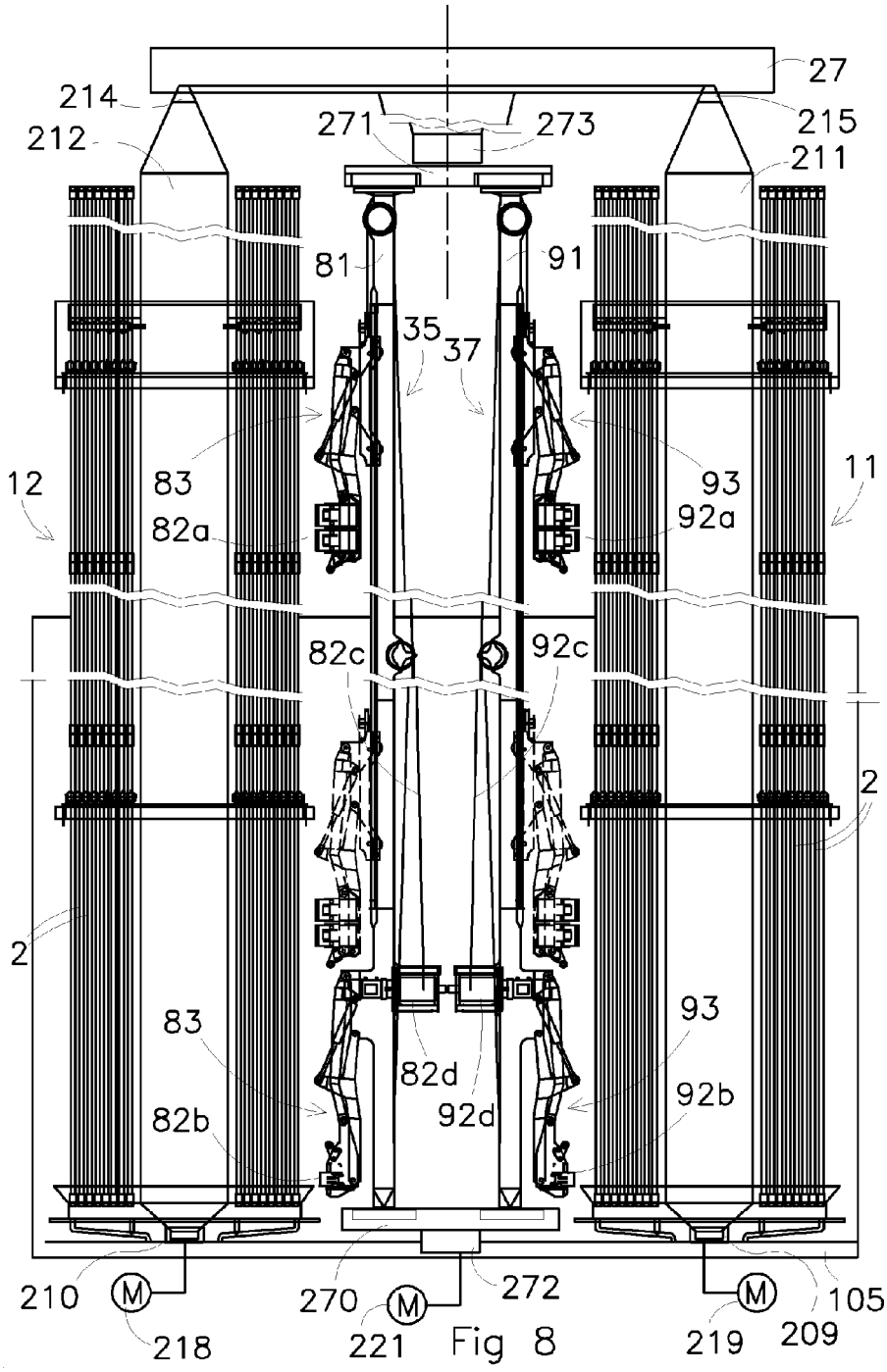
FIG. 8 shows a detail of another embodiment of a drilling installation according to the invention.

FIG. 8 show in detail another embodiment of a drilling installation according to the invention. Shown are a portion of a top structure 27, which is part of a tower structure. The rest of the tower structure is not shown for simplicity reasons. Further, a portion of a base 105 is shown.

Between the base 105 and the top structure 27 two storage devices 11,12 are provided, each storage device being located in a corresponding leg of the tower structure (not shown). Each storage device 11,12 is rotatable about a vertical axis. As can be seen a lower bearing 212,213 is present at the lower end of each storage device, connecting the storage device to the base. Also, as is preferred, an upper bearing 214,215 is present at the top end of the storage device, connecting said top end to the top structure.

As is known in the art, each storage device includes slots for the storage of multiple tubulars 2 in each storage device in vertical orientation. As is known in the art, the storage devices here include a central vertical post 211,212, and multiple disc members at different height of the post, at least one them provided with said storage slots and possibly also with operable latches as common in fingerboards. It is envisaged that in a preferred embodiment, the tubulars 2 rest with their lower end on a lowermost disc member. In the example shown in FIG. 8 it is envisaged that tubular elements comprising of three single tubulars, i.e. triples or triple stands, are stored in the storage devices. The diameter of each storage device is about 8 meters.

Also schematically indicated are drive motors 218,219 for each of the storage devices that allow to rotate the storage device about its vertical axis. In a possible embodiment the drive motors 218,219 are embodied as part of an indexing drive for the storage devices, so that each of the storage devices can be brought in a multitude of predetermined rotary positions.

In between the storage devices, a rotary structure is provided that is rotatable about a vertical axis and has a corresponding drive 221 to rotate the rotary structure about said vertical axis. The rotary structure supports at a first side thereof a first pipe racker 35 and at a second side thereof a second pipe racker 37. These pipe rackers are preferably of the same design, and each pipe racker includes one or more moveable gripping members 82*a*,82*b*,92*a*,92*b* adapted to grip a tubular 2 to be removed from a storage device or placed in said storage device.

In this example, as is known from the prior art, the first and second pipe racker each include a first and second vertical column member 81,91 respectively, said column members each supporting said one or more gripping members. In this example, each column member supports multiple, here two, gripping members 82*a*,82*b*,92*a*,92*b*. In this example, and as is also known from the prior art, each gripping member is mounted on a motion device, here an articulated arm 83,93, allowing to displace the gripping member within a reach outside of the column member.

Also in this example, and also known from the prior art, some or all gripping members, here upper gripping members 82*a*,92*a*, are vertically displaceable along the column member 81,91, e.g. by an associated cable 82*c*,92*c* and winch 82*d*,92*d*, in order to adjust the height position of the gripping members to the tubulars 2 to be handled. The upper gripping members are shown with dashed lines in a lower position in FIG. 8.

As is also known from the prior art, and not shown, a drive motor (not shown) is associated with each column member 81,91 allowing to pivot the column member about its vertical axis, thereby moving the gripping members and any tubular held by said gripping members.

As can be seen in FIG. 8 the first and second vertical column member 81,91 are mounted on a rotary support with a space between said first and second vertical column members 81,91.

In this example, the rotary support of the column members includes a base member 270 to which the column members are connected with their lower end and a top member 271 to which the column members are connected with their upper end.

Here the base member 270 is supported via a bearing 272 on the base and the top member 271 is supported by a bearing 273 from the top structure 27.

In general the rotary structure is formed here by the base member 270 and the top member 271, and is rotatable about a vertical axis. A drive motor 221, here engaging on the base member is provided to perform said motion. A synchronized drive motor may act on the top member or top end of the rotary structure to avoid excessive torsional loads on the rotary structure.

By rotation of the rotary structure, the pipe rackers are moveable between a first firing line side of the tower structure and a second firing line side of the tower structure and can also be combined with the other storage device than shown in FIG. 8. This allows for any combination between storage device, pipe racker and firing line, so that in case one pipe racker fails, the other pipe racker can take over.

Figure 9:
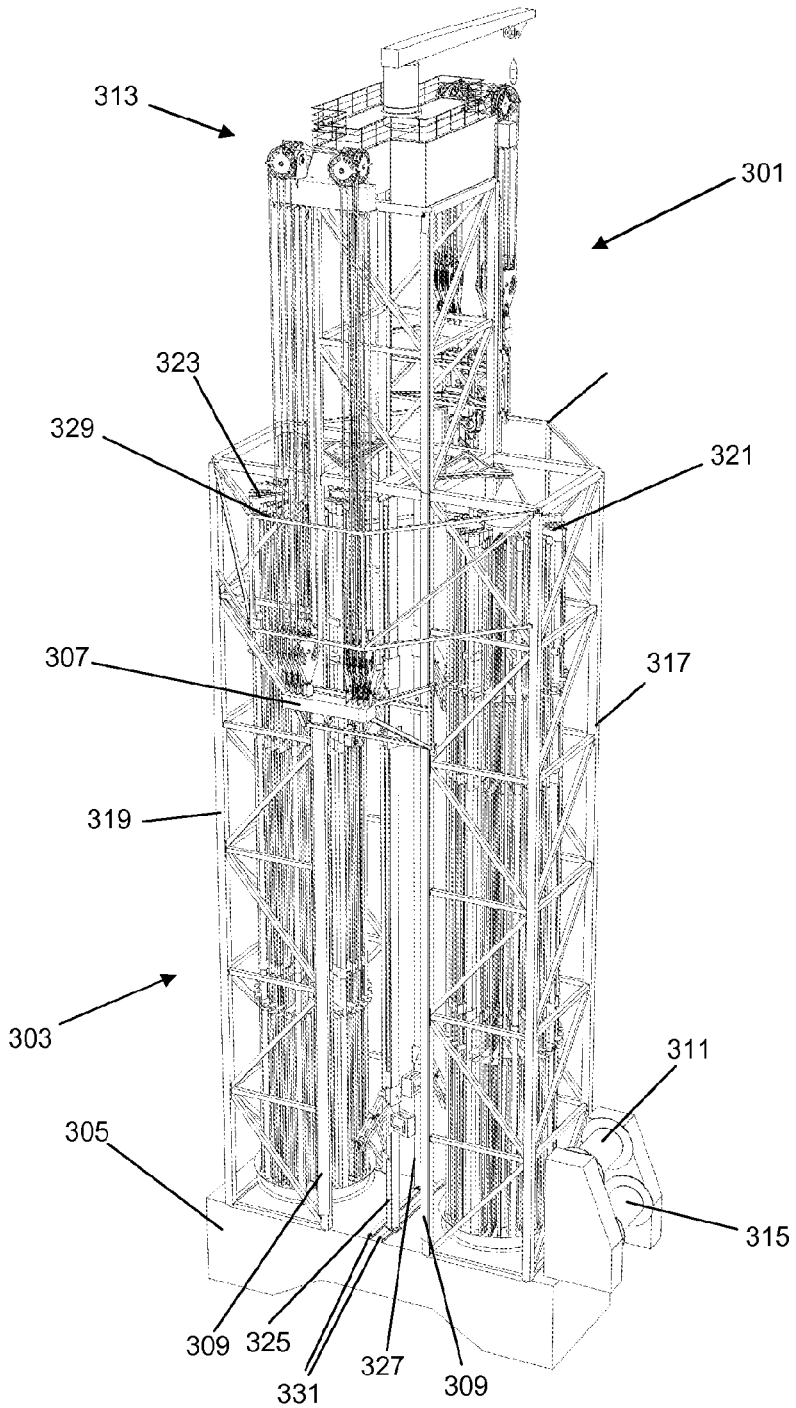
FIG. 9 shows a drilling installation to yet another embodiment of the invention.

FIG. 9 shows a drilling installation 301 for drilling a well according to yet another embodiment of the invention in perspective view. The drilling installation comprises a base 305 which is partially shown in FIG. 9, and a tower structure 303 provided on top of the base 305. The base 305 may form part of a drilling vessel (not shown).

The installation further comprises first hoisting means adapted to manipulate a first object in a first firing line in the longitudinal direction of the tower structure. The first hoisting means comprise a trolley 307 which is moveable along the tower structure and guided by associated rails or tracks 309, a hoisting winch 311, and cables and sheave assemblies in between the winch and trolley as is known in the art. Only the cables and sheave assemblies between trolley and top structure 313 are shown.

On the other side of the installation, second hoisting means are provided which are adapted to manipulate a second object in a second firing line in the longitudinal direction of the tower structure. Although this side of the installation is less visible, the construction of the second hoisting means is similar to the first hoisting means. The second hoisting means thus also comprise a trolley moveable along the tower structure and guided by rails, cables and sheave assemblies, and a winch 315.

The tower structure has a first leg 317 and a second leg 319 at a distance of the first leg, wherein the first and second leg each accommodate a respective storage device 321, 323. Each storage device is configured for vertically storing tubular elements, such as joined tubulars. The storage devices are similar in configuration as the storage device as in the embodiment of FIG. 6.

Both legs of the tower structure have a respective opening, which have a length that is at least equal to a maximum length of a tubular element in the storage device. Each opening faces the other opening.

In between the legs of the tower structure, two pipe rackers 325, 327 are provided for moving tubular elements between one of the storage devices and one of the firing lines. The pipe rackers are moveable between the first firing line side of the tower structure and the second firing line side of the tower structure to have access to both firing lines. The pipe rackers are moveable between the first firing line side and the second firing line side of the tower structure along guides 331, which are only depicted at the bottom of the pipe rackers, but are also provided at the top of the pipe rackers.

As can be seen, the tower structure is a lattice structure. The firing lines are substantially outside the tower structure. However, at the top of the two legs, a bar construction 329 is provided around each firing line. This bar construction is preferably removable, to allow objects to be placed in a firing line from the outside of the tower structure. The bar construction does not interfere with placing objects in the firing line from inside the tower structure. The main function of the bar construction is to prevent tubular elements from falling out of the firing line onto the base, i.e. away from the tower structure.

The invention claimed is:

1. A drilling installation for drilling a well by means of said installation, which installation comprises:

a tower structure;

a first hoisting device adapted to manipulate a first object in a first firing line in the longitudinal direction of the tower structure;

a second hoisting device adapted to manipulate a second object in a second firing line in the longitudinal direction of the tower structure;

a storage device for vertically storing tubular elements; and a first pipe racker for moving tubular elements between the storage device and the first firing line;

wherein the first and second firing lines are located outside the tower structure, and the storage device is located inside the tower structure, wherein the first pipe racker is also configured for moving tubular elements between the storage device and the second firing line, and wherein the first pipe racker is configured to move tubular elements between the storage device and the first or second firing lines via an opening in the tower structure, wherein said opening has a length which is at least equal to a maximum length of a tubular element in the storage device.

2. The installation according to claim 1, wherein the first pipe racker is moveable between the first firing line side of the tower and the second firing line side of the tower.

3. The installation according to claim 1, wherein the tower structure has a first leg and a second leg at a distance of the first leg, the first leg accommodating the storage device and being provided with said opening, and wherein the first pipe racker is located between the first and second leg of the tower.

4. The installation according to claim 3, wherein said opening in the first leg faces the second leg.

5. The installation according to claim 3, wherein a further storage device is located in the second leg, the second leg being provided with a respective opening through which tubular elements can be moved between the further storage device and the first or second firing line by the first pipe racker, and wherein the length of the opening in the second leg is at least equal to a maximum length of a tubular element in the further storage device.

6. The installation according to claim 5, wherein the opening in the first leg and the opening in the second leg face each other.

7. The installation according to claim 3, wherein the first leg and the second leg have a U-shaped cross section in plan view.

8. The installation according to claim 1, wherein the tower structure is a lattice structure.

9. The installation according to claim 1, wherein the storage device is a rotary storage device.

10. The installation according to claim 1, wherein the tower structure comprises an U-shaped cross section in plan view, and wherein the storage device is located in the U-shaped cross section.

11. The installation according to claim 1, comprising a base with a construction floor for each firing line, wherein the tower structure with the storage device and the first pipe racker is located on the base.

12. The installation according to claim 1, wherein the first pipe racker comprises one or more gripping members adapted to grip a tubular.

13. The installation according to claim 12, wherein the first pipe racker comprises a vertical column member supporting the respective one or more gripping members.

14. A vessel comprising a drilling installation according to claim 1.

15. A method for drilling a well, comprising the steps of:

providing the drilling installation according to claim 1; and moving the tubular elements between the storage device of the drilling installation and the first or second firing lines via the opening in the tower structure of the drilling installation.

16. A drilling installation for drilling a well by means of said installation, which installation comprises:

a tower structure;

a first hoisting device adapted to manipulate a first object in a first firing line in the longitudinal direction of the tower structure;

a second hoisting device adapted to manipulate a second object in a second firing line in the longitudinal direction of the tower structure;

a storage device for vertically storing tubular elements; and a first pipe racker for moving tubular elements between the storage device and the first firing line;

wherein the first and second firing lines are located outside the tower structure, and the storage device is located inside the tower structure, wherein the first pipe racker is also configured for moving tubular elements between the storage device and the second firing line, wherein the installation comprises a second pipe racker for moving tubular elements between the storage device and the second firing line, and the second pipe racker is also configured for moving tubular elements between the storage device and the first firing line, and wherein the first pipe racker and the second pipe racker are configured to move tubular elements between the storage device and the first or second firing lines via an opening in the tower structure, wherein said opening has a length which is at least equal to a maximum length of a tubular element in the storage device.

17. The installation according to claim 16, wherein the first pipe racker and the second pipe racker are moveable between the first firing line side of the tower and the second firing line side of the tower.

18. The installation according to claim 16, wherein the tower structure has a first leg and a second leg at a distance of the first leg, the first leg accommodating the storage device and being provided with said opening, and wherein the first pipe racker and the second pipe racker are located between the first and second leg of the tower.

19. The installation according to claim 18, wherein said opening in the first leg faces the second leg.

20. The installation according to claim 18, wherein a further storage device is located in the second leg, the second leg being provided with a respective opening through which tubular elements can be moved between the further storage device and the first or second firing line by the first pipe racker and by the second pipe racker, and wherein the length of the opening in the second leg is at least equal to a maximum length of a tubular element in the further storage device.

* * * * *